US011434732B2

(12) United States Patent
Kleemeier et al.

(10) Patent No.: US 11,434,732 B2
(45) Date of Patent: Sep. 6, 2022

(54) FLOATING GAS LIFT METHOD

(71) Applicant: Excelerate Energy Limited Partnership, The Woodlands, TX (US)

(72) Inventors: Henry George Kleemeier, Tulsa, OK (US); Daniel Horacio Bustos, Conroe, TX (US); Kenneth Hugh McGeachie, Montgomery, TX (US); Graeme David Trotter, Edinburgh (GB)

(73) Assignee: Excelerate Energy Limited Partnership, The Woodlands, TX (US)

( * ) Notice: Subject to any disclaimer, the term of this patent is extended or adjusted under 35 U.S.C. 154(b) by 0 days.

(21) Appl. No.: 16/744,718

(22) Filed: Jan. 16, 2020

(65) Prior Publication Data

US 2020/0224519 A1 Jul. 16, 2020

Related U.S. Application Data

(60) Provisional application No. 62/793,321, filed on Jan. 16, 2019.

(51) Int. Cl.

| | |
|---|---|
| ***E21B 43/12*** | (2006.01) |
| ***E21B 43/01*** | (2006.01) |
| ***E21B 17/01*** | (2006.01) |

(52) U.S. Cl.

CPC ..... *E21B 43/122* (2013.01); *E21B 43/01* (2013.01); *E21B 17/01* (2013.01)

(58) Field of Classification Search

CPC ..... E21B 43/122; E21B 43/01; F17C 2270/0102; F17C 2270/0105; F17C 2270/0118

See application file for complete search history.

(56) References Cited

U.S. PATENT DOCUMENTS 5,549,164 A * 8/1996 Blandford ..... B63B 21/502 166/344
6,089,022 A * 7/2000 Zednik ..... F17C 9/02 60/641.7

(Continued)

FOREIGN PATENT DOCUMENTS

WO WO-2010120908 A2 * 10/2010 ..... F16L 37/002
WO 2012030476 A3 3/2012

OTHER PUBLICATIONS

Han, Hans Y.S., Lee, Jung Han, and Yong Soo Kim. "Design Development of FSRU from LNG Carrier and FPSO Construction Experiences." Paper presented at the Offshore Technology Conference, Houston, Texas, May 2002. doi: https://doi.org/10.4043/14098-MS (Year: 2002).*

(Continued)

*Primary Examiner* — Blake Michener
*Assistant Examiner* — Theodore N Yao
(74) *Attorney, Agent, or Firm* — Frederic Dorwart, Laywers PLLC; Penina Michlin Chiu

(57) ABSTRACT

A method for floating gas lift includes injecting natural gas from a FSRU into an annulus of an oil well, wherein the FSRU is fluidly coupled to the oil well, and the natural gas is pressurized for gas lift using at least one pump onboard the FSRU. An apparatus for floating gas lift includes a FSRU including a pump system having a high pressure (HP) LNG discharge and a regasification system including HP gaseous natural gas discharge fluidly coupled to an annulus of a downhole well, and production tubing that lifts a combined production fluid, the combined production fluid including downhole formation fluid entering the inside of the production tubing through perforations in the well casing and a production tubing inlet, and gaseous natural gas discharged (Continued)

from the FSRU entering the inside of the production tubing through the annulus and a valve in the production tubing.

7 Claims, 12 Drawing Sheets

(56) References Cited

U.S. PATENT DOCUMENTS

| | | | | |
|---|---|---|---|---|
| 6,517,286 | B1 * | 2/2003 | Latchem | F17C 1/007 166/335 |
| 6,546,739 | B2 | 4/2003 | Frimm et al. | |
| 6,598,408 | B1 | 7/2003 | Nierenberg | |
| 6,622,791 | B2 | 9/2003 | Kelley et al. | |
| 6,688,114 | B2 | 2/2004 | Nierenberg | |
| 7,219,502 | B2 | 5/2007 | Nierenberg | |
| 7,293,600 | B2 | 11/2007 | Nierenberg | |
| 7,484,371 | B2 | 2/2009 | Nierenberg | |
| 7,717,762 | B2 | 5/2010 | Boatman et al. | |
| 9,004,818 | B2 | 4/2015 | Laborde et al. | |
| 10,247,338 | B2 | 4/2019 | Bryngelson et al. | |
| 10,549,820 | B2 | 2/2020 | Lane et al. | |
| 2002/0134455 | A1 | 9/2002 | Emblem et al. | |
| 2003/0051875 | A1 * | 3/2003 | Wilson | B65G 5/005 166/268 |
| 2005/0061396 | A1 * | 3/2005 | Landry | F17C 7/04 141/388 |
| 2005/0158126 | A1 * | 7/2005 | Luppi | B63B 22/18 405/224.2 |
| 2006/0080973 | A1 * | 4/2006 | Pollack | F17C 9/02 62/53.2 |
| 2006/0096760 | A1 | 5/2006 | Ohmer | |
| 2007/0144184 | A1 | 6/2007 | Wijingaarden et al. | |
| 2007/0144738 | A1 | 6/2007 | Sugiyama et al. | |
| 2008/0210432 | A1 * | 9/2008 | Crossley | E21B 43/017 166/338 |
| 2009/0151954 | A1 * | 6/2009 | Krehbiel | E21B 43/129 166/335 |
| 2010/0252260 | A1 * | 10/2010 | Fowler | F17D 1/17 166/275 |
| 2012/0000668 | A1 * | 1/2012 | Rexilius | E21B 43/121 166/105.6 |
| 2013/0153217 | A1 | 6/2013 | Smith | |
| 2014/0000899 | A1 * | 1/2014 | Nevison | E21B 43/26 166/308.1 |
| 2014/0014336 | A1 * | 1/2014 | Smith | E21B 43/24 166/272.1 |
| 2015/0308245 | A1 | 10/2015 | Stewart et al. | |
| 2016/0215930 | A1 | 7/2016 | Nelson et al. | |
| 2016/0230519 | A1 | 8/2016 | Leniek | |
| 2016/0237804 | A1 * | 8/2016 | Papadimitriou | E21B 17/01 |
| 2016/0298432 | A1 * | 10/2016 | Leniek, Sr. | E21B 43/129 |
| 2017/0107811 | A1 * | 4/2017 | Romer | E21B 43/14 |
| 2017/0356597 | A1 * | 12/2017 | Nevison | F17C 9/02 |
| 2019/0120029 | A1 * | 4/2019 | Knight | E21B 43/18 |
| 2020/0018141 | A1 * | 1/2020 | Voigt | E21B 43/166 |
| 2020/0025334 | A1 * | 1/2020 | Barclay | F25J 1/0204 |
| 2020/0032629 | A1 * | 1/2020 | Bean | E21B 43/122 |

OTHER PUBLICATIONS

Maurice Stewart, 2—Pump fundamentals, Editor(s): Maurice Stewart, Surface Production Operations, Surface Production Operations, Gulf Professional Publishing, 2018, p. 9, ISBN 9780128098950, https://doi.org/10.1016/B978-0-12-809895-0.00002-8. (Year: 2018).*

Han, Hans Y.S. et al., Design Development of FSRU from LNG Carrier and FSPO Construction Experiences, Offshore Technology Conference, Houston, Texas May 6-9, 2002, 8 pages.

Patent Cooperation Treaty, "International Search Report" for PCT Application No. PCT/US2020/013825, dated May 27, 2020, 3 pages.

Patent Cooperation Treaty, "Written Opinion of the International Searching Authority" for PCT Application No. PCT/US2020/013825, dated May 27, 2020, 8 pages.

Wikipedia, "Offshore drilling" taken from https://en.wikipedia.org/wiki/Offshore_drilling, Dec. 7, 2020, 6 pages.

Patent Cooperation Treaty, "International Preliminary Report on Patentability" for PCT Application No. PCT/US2020/013825, dated Mar. 26, 2021, 4 pages.

* cited by examiner

FLOATING GAS LIFT METHOD

CROSS REFERENCE TO RELATED APPLICATIONS

This application claims the benefit of U.S. Provisional Application No. 62/793,321 to Kleemeier et al., filed Jan. 16, 2019 and entitled "FLOATING GAS LIFT SYSTEM, APPARATUS AND METHOD," which is hereby incorporated by reference in its entirety.

BACKGROUND OF THE INVENTION

1. Field of the Invention

Embodiments of the invention described herein pertain to the field of offshore gas lift assist. More particularly, but not by way of limitation, one or more embodiments of the invention enable a floating gas lift system, apparatus and method.

2. Description of the Related Art

Fluid, such as crude oil or water, is often located in underground formations ("reservoirs"). When pressure within the reservoir is no longer enough to force fluid out of the well, a means of artificial lift is typically used to bring the production fluid to the surface so that the fluid can be collected, separated, refined, distributed and/or sold. Artificial lift is often needed towards the end of life of a production well, when the fluid remaining in the well is dense and heavy, causing well production to drop. Currently, there are two primary categories of artificial lift: gas lift on the one hand, and pumps on the other, such as electric submersible pumps, beam pumps or hydraulic pumps. Gas lift is often a preferable method over a pump because wells that are narrow or close together may not have enough space to accommodate a pump. Pumps also require frequent maintenance and risk being clogged by sand or gas locking, depending on well composition. For this reason gas lift is often the preferred or only feasible artificial lift solution to extend the life of a production well.

In gas lift, high pressure gas is injected into the well and mixes with the well fluid to decrease the density of the well fluid and thus reduce the hydrostatic pressure at the bottom of the wellbore. The reduced fluid density increases the differential pressure between the bottomhole and formation pressures, allowing the reservoir pressure to push the mixture of produced fluids and gas up to the surface. In the case of oil wells, natural gas is often naturally present in the mixture of downhole fluids, and as the production fluid is collected, the natural gas is separated and cycled through the well to enhance lift. For this reason, injected natural gas is a modern solution to bottomhole pressure in gas lift applications for oil wells. To allow the use of natural gas originating from the formation as an injection gas, the natural gas must be lifted and separated from the reservoir fluid in a production separator, and then treated to remove $CO_2$, $H_2S$ and water, as needed. Next, the natural gas must be compressed for injection. Preferably, high quality gas for gas lift applications should have a low water dewpoint to prevent hydrate formation, low hydrocarbon dewpoint to prevent pipeline blockages, low $CO_2$ and $H_2S$ content to reduce toxicity hazards, and low molecular weight to improve gas lift performance. Nitrogen or other inert gas can sometimes alternatively be used as injection gas, but these inert gases have no heating value. Thus, the use of inert gas in significant quantities over time lowers the energy content of the produced gas stream to a level where it causes problems downstream. In such instances, rather than being used as an energy source, the well gas is flared and wasted.

A problem in using gas lift for oil wells, is that a source of natural gas is not always readily available for high-pressure injection. Because a sufficient amount of natural gas may not be naturally present within the well, or the gas that is present may be too sour or low quality, gas lift applications may require an external source of natural gas for injection. However, particularly when the production well is offshore, it may not be feasible to transmit externally sourced natural gas by pipeline to the well. In addition, for gas lift, the injected gas must be at high pressures, such as at least about $41\times10^5$ Pa (40 barg). Currently, to bring the injected gas up to sufficient pressure for gas lift procedures, compression systems in combination with air-cooled heat exchangers must be used to compress the gas and remove heat in several stages. These compression systems are expensive and require large amounts of energy to operate, which is particularly problematic offshore where power generation is costly and at a premium. Thus, due to inaccessibility of high quality, high-pressure gas, the total lifting cost may exceed the value of oil, and a well under such circumstances may be abandoned rather than fitted with an artificial lift solution.

Over the past decade, a method of transporting natural gas onboard special cryogenic tanker ships has developed. Since liquefied natural gas (LNG) occupies only about 1/600th of the volume than does the same amount of natural gas in its gaseous state, natural gas carried by these tanker ships is liquefied for transport, earning these special cryogenic tanker ships the name "LNG carrier". Liquefied natural gas (LNG) is produced in liquefaction plants by cooling natural gas below its boiling point (about −160° C. at atmospheric pressure, depending on cargo grade). The LNG may be stored in cryogenic containers onboard the LNG carrier either at or slightly above atmospheric pressure. In most instances, LNG transported by LNG carrier is transported in liquefied form to a land-based delivery point, where a land-based regasification system converts the LNG back into gas.

Some LNG carriers are equipped with shipboard regasification facilities capable of converting the LNG back into a gaseous state. These "regasification" facilities vaporize the gas by adding heat to raise the temperature of LNG to at least its boiling point. LNG carriers equipped with onboard regasification facilities are called Regasification Vessels or Floating Storage Regasification Units (FSRU). In order to deliver regasified natural gas, the regasification vessels dock at a special buoy connected to an underwater pipeline, which in turn connects to an onshore gas distribution system. These specialized FSRU delivery systems have high capital cost due to the specialized infrastructure that needs to be constructed, and high operating costs (e.g., vessel fuel, crew costs, natural gas supply) that are typically only justified where large cargoes of LNG are required consistently for a decade or more, with FSRUs ranging from 138,000 $m^3$-266,000 $m^3$ of LNG capacity sending gas to downstream customers such as power utilities.

As is apparent from the abovementioned problems, current offshore gas lift methods are limited in their ability to service wells that do not have sufficient naturally occurring gas, and even wells with enough naturally occurring gas suffer from the high cost of offshore compression. Further, the solution of using external sources of offshore natural gas suffers from inflexible delivery limitations and economies of scale. Therefore, there is a need for an improved floating gas lift system, apparatus and method.

BRIEF SUMMARY OF THE INVENTION

One or more embodiments of the invention enable a floating gas lift system, apparatus and method.

A floating gas lift system, apparatus and method is described. An illustrative embodiment of a floating gas lift method includes pumping LNG onboard an FSRU through a compressorless pump system to pressurize the LNG and form high pressure LNG, vaporizing the high pressure LNG onboard the FSRU to produce high pressure regasified natural gas, injecting the high pressure regasified natural gas from the FSRU into an annulus of a hydrocarbon well, and lifting a combined fluid from the hydrocarbon well, the combined fluid including regasified natural gas from the FSRU, and downhole hydrocarbon fluid. In some embodiments, the floating gas lift method further includes mooring the FSRU at a submerged buoy prior to injecting the high pressure regasified natural gas into the annulus of the hydrocarbon well. In certain embodiments, injecting the high pressure regasified natural gas from the FSRU into the annulus of the hydrocarbon well further includes flowing the high pressure regasified natural gas from the FSRU through the submerged buoy, through a flexible riser, into a subsea manifold, and into the annulus. In some embodiments, injecting the high pressure regasified natural gas from the FSRU into the annulus of the hydrocarbon well further includes transferring the high pressure regasified natural gas from the FSRU to a high pressure gas manifold, and flowing the high pressure regasified natural gas from the high pressure gas manifold into the annulus. In certain embodiments, the floating gas lift method further includes mooring the FSRU at an offshore platform for injection of the high pressure regasified natural gas from the FSRU in the annulus. In some embodiments, the floating gas lift method further includes receiving the combined fluid on an offshore platform, separating the combined fluid into produced liquid and produced gas, and recirculating the produced gas from the offshore platform into the annulus. In certain embodiments, the floating gas lift method further includes receiving the combined fluid on an offshore platform, and using at least a portion of the combined fluid as fuel for equipment onboard the offshore platform. In some embodiments, the floating gas lift method further includes treating the combined fluid prior to use as fuel. In some embodiments, treating the combined fluid further includes separating the combined fluid into gas and liquid, and treating the gas with sweetening, dehydration, export compression or a combination thereof. In certain embodiments, the floating gas lift method further includes receiving the combined fluid on an offshore platform, and separating the combined fluid into produced gas and produced liquid. In some embodiments, the floating gas lift method further includes transmitting the produced gas from the offshore platform to onshore for distribution.

An illustrative embodiment of an apparatus for floating gas lift includes a FSRU including a pump system including a low pressure LNG intake and a high pressure LNG discharge, and a regasification system coupled to the high pressure LNG discharge and including a high pressure gaseous natural gas discharge fluidly coupled to an annulus of a downhole well, production tubing extending between the downhole well and a production platform, the production tubing including a valve, an inside of the production tubing fluidly coupled to the annulus through the valve, the annulus extending between well casing and an outside of the production tubing, and a downhole formation through perforations in the well casing and an inlet in the production tubing, wherein the production tubing is configured to lift a combined production fluid including a downhole formation fluid entering the inside of the production tubing through the perforations and the inlet, and gaseous natural gas discharged from the FSRU entering the inside of the production tubing through the annulus and the valve. In some embodiments, the pump system includes a plurality of positive displacement pumps connected in series. In certain embodiments, the pump system includes a plurality of multi-stage centrifugal pumps connected in parallel. In some embodiments, the apparatus further includes a submerged buoy, a subsea riser and a subsea manifold coupled between the high pressure gaseous natural gas discharge and the annulus. In some embodiments, the apparatus further includes a high pressure gas manifold and a high pressure arm coupled between the high pressure gaseous natural gas discharge and the annulus. In some embodiments, the production platform includes fluid separation equipment, and further including gas pipeline extending from the fluid separation equipment to the annulus. In certain embodiments, the production platform includes fluid separation equipment and further including a gas pipeline and a liquid pipeline extending from the production platform to shore.

An illustrative embodiment of a floating gas lift system includes a FSRU moored offshore at a submerged buoy, the FSRU including onboard a pump system fluidly coupled between a LNG tank and a LNG regasification system, wherein the LNG regasification system accepts LNG and outputs regasified natural gas, and wherein LNG is pumped by the pump system such that the regasified natural gas from the regasification system is discharged to the submerged buoy at above a production tubing pressure, the FSRU floating proximate at least one subsea oil well, the at least one subsea oil well including the production tubing having production fluid flowing therethrough at the production tubing pressure, and the submerged buoy including a flexible riser fluidly coupled to a subsea pressure control manifold, the subsea pressure control manifold fluidly coupling the regasified natural gas at above the production tubing pressure into an annulus between a well casing and the production tubing of the subsea oil well. In some embodiments, the regasified natural gas is fluidly coupled to an annulus between a well casing and the production tubing, and further including a combined stream of the regasified natural gas and the production fluid flowing through the production tubing, an offshore platform proximate to the FSRU and fluidly coupled to the production tubing, the offshore platform including a separation system configured to separate the combined stream into produced gas and produced liquid, and wherein the produced gas is then one of transmitted onshore for distribution, used for fuel for equipment onboard the offshore platform, recirculated into the annulus, or a combination thereof. In certain embodiments, the pump system onboard the FSRU includes at least one positive displacement pump. In some embodiments, the pump system onboard the FSRU includes at least two positive displacement pumps in series. In certain embodiments, the production tubing pressure is at least $101\times10^5$ Pa (100 barg). In certain embodiments, the production tubing pressure is between $41\times105$ Pa (40 barg) and $101\times10^5$ Pa (100 barg). In some embodiments, the regasification system includes a plurality of vaporizers in parallel, steam as a heat source to the plurality of vaporizers, and wherein the regasified natural gas is discharged to the subsea buoy at a temperature of at least 35° C.

An illustrative embodiment of a method for floating gas lift includes injecting natural gas from a FSRU into an annulus of an oil well, wherein the FSRU is fluidly coupled to the oil well and the natural gas is pressurized for gas lift using at least one pump onboard the FSRU.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which:

FIG. 6 is a side elevation view of an offshore gas lift method with regasified natural gas recirculation.

Figure 1:
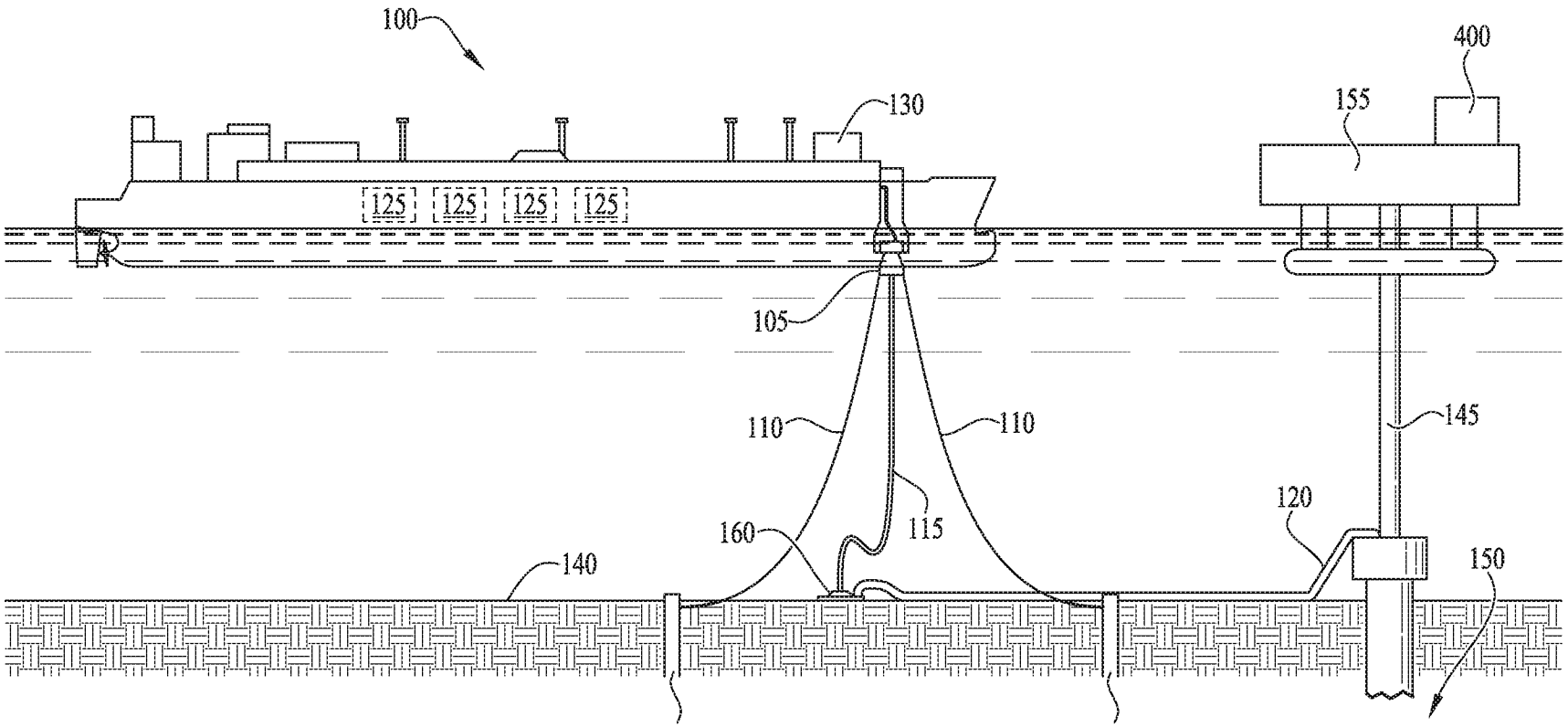
FIG. 1 is a side elevation view of a floating gas lift system of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A floating gas lift system, apparatus and method will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a pump includes one or more pumps.

"Coupled" refers to either a direct connection or an indirect connection (e.g., at least one intervening connection) between one or more objects or components. The phrase "directly attached" means a direct connection between objects or components.

As used in this specification and the appended claims "high pressure" means, with respect to gaseous natural gas or LNG, a pressure of at least $41\times10^5$ Pa (40 barg). With respect to pipelines and arms, "high pressure" means accommodating and transmitting gaseous natural gas or LNG, as the case may be, at a pressure of at least $41\times10^5$ Pa (40 barg).

As used in this specification and the appended claims "low pressure" means, with respect to LNG, a pressure of less than $11\times10^5$ Pa (10 barg). With respect to pumps and pipes, "low pressure" means accepting and transmitting LNG at a pressure of less than $11\times10^5$ Pa (10 barg).

As used in this specification and the appended claims "high quality" with respect to gaseous natural gas, means LNG quality gas (gas that is in condition to be liquefied) and/or gas that has had carbon dioxide, hydrogen sulfide, water, mercury and other light components which tend to freeze removed.

As used in this specification and the appended claims, "FSRU" is used liberally to refer to any of a regasification vessel, a floating storage regasification unit and/or a floating regasification unit (FRU).

As used in this specification and the appended claims "direct heat exchange" means heat exchange without the use of an intermediary heat exchange fluid. For example, steam flowing through the inside of finned tubes whilst cool air flows around the outside of the finned tubes is one non-limiting example of direct heat exchange between the steam and the cool air. Where a heat exchange fluid, such as a glycol water mixture or fresh water, is used as an intermediary to transfer heat between two other elements, such as to transfer heat between seawater and LNG by transferring heat from the seawater first to the fresh water and then from the fresh water to the LNG, such is referred to herein as "indirect" heat exchange.

Illustrative embodiments are primarily described herein with respect to an oil well offshore in the ocean. However, illustrative embodiments are not so limited and may equally apply to wells offshore in lakes or rivers or other similar large bodies of water, or to wells located onshore that may be connected to the FSRU by high pressure pipeline and receive high pressure natural gas discharged from the FSRU through the high pressure pipeline.

Illustrative embodiments may provide a system for providing and/or injecting high pressure, high quality natural gas to offshore oil wells in need of gas lift assist, without the need for power-intensive compressors or an indigenous natural gas source. Illustrative embodiments may supply natural gas to offshore oil wells, which oil wells may be remote or stranded, without the need for long, expensive subsea pipelines that may be difficult to build and permit. Illustrative embodiments may reduce the lift cost of oil, which may make gas lift economical in a wider range of conditions, conserve energy resources and provide improved gas lift systems and methods.

A gas lift system of an illustrative embodiment may include a FSRU floating offshore proximate to a subsea oil well. The FSRU may include LNG cargo and a LNG vaporizer onboard. A specialized system of pumps onboard the FSRU may circulate the LNG at high pressure from the LNG cargo tanks through the vaporizer to produce pressurized natural gas. The pressurized natural gas discharged from the FSRU may be injected directly into the subsea oil well without additional treatment and without the need for any compression. To accomplish gas lift, the pressurized natural gas discharged from the FSRU may be injected between the casing and production tubing of the subsea oil well. The injected natural gas from the FSRU may combine with the downhole fluid from the subsea oil well and together the combined stream may be produced through the well's production tubing to an offshore platform.

Separation of gas and liquid in the combined stream of production fluid may occur on an offshore platform. Once separated, the gas may still be of near LNG-quality (although diluted by any naturally occurring gas in the formation), and may be reinjected into the subsea oil well or used as fuel for equipment onboard the offshore platform such as power generators, separation equipment or export compressors. Alternatively, or in addition to recirculation or use as fuel, produced natural gas and/or natural gas originating from the FSRU may be transported to shore for distribution, to power utilities and/or for power generation. The FSRU may replenish high quality gas for gas lift, as needed to replace gas used as fuel, distributed gas or to increase the quality of gas diluted by gas naturally occurring within the formation. Injection gas from the FSRU may be up to $401\times10^5$ Pa (400 barg) and 35° C., improving the effectiveness of gas lift whilst using less power to do so than methods that rely on compression.

FIG. 1 illustrates an offshore gas lift system of an illustrative embodiment. FSRU 100 may be berthed, docked and/or moored at buoy 105 in a navigable body of water such as the ocean, a lake or river. Buoy 105 may be a subsea turret buoy (sometimes referred to as a submerged turret loading or "STL" buoy), as shown in FIG. 1, or an external turret buoy (not shown). One or more anchor lines 110 may secure buoy 105 to seabed 140 with anchors 135. Riser 115, which may be a submerged flexible riser, steel catenary riser, steel export riser and/or umbilical may extend from buoy 105 to seabed 140, and may fluidly connect buoy 105 to subsea natural gas pipeline 120, either through a subsea ring main or via subsea flow/pressure control manifold 160, the latter of which may provide a connection directly to oil well 150 through riser 115 and/or subsea natural gas pipeline 120. Natural gas pipeline 120 may extend towards and/or into oil well 150 and/or annulus 330 (shown in FIG. 3). FSRU 100 may berth to buoy 105 at and/or proximate to the forward end and/or bow of FSRU 100. In some embodiments, FSRU 100 may be moored at offshore platform 155, a dock or a sea island, rather than buoy 105. In such instances high pressure gas arm 800 (shown in FIG. 8) may transfer natural gas from FSRU 100 to pipeline 120 on offshore platform 155, the dock or the sea island, and natural gas pipeline 120 may extend along offshore platform 155, the dock or the sea island into oil well 150.

FSRU 100 may be a mobile floating storage regasification unit, a regasification vessel, a floating regasification unit (FRU) and/or another floating vessel or platform with LNG regasification facilities 130 onboard, and the ability to both receive LNG cargo 200 (shown in FIG. 2A) as a liquid and discharge such cargo as a gas. LNG cargos 200 onboard the FSRU may be replenished using ship-to-ship transfer from a LNG carrier (LNGC). Suitable LNG ship-to-ship transfer equipment may be as described in WO 2010/120908 to Bryngelson et al., which is commonly owned and incorporated herein by this reference in its entirety; provided however that in the event of any conflict, the present disclosure shall prevail. FSRU 100 may remain moored at buoy 105 for several days, several weeks or several years. FSRU 100 may store LNG cargo 200 in cryogenic cargo tanks 125 in the hull of the FSRU 100. Cryogenic LNG cargo tanks 125 may be membrane, self-supporting, prismatic, self-supporting spherical type cargo tanks or another similar type of cargo tank and are well known to those of skill in the art. FSRU 100 may include a steam turbine as the main propulsion engine, may include a dual-fuel diesel engine or another similar marine propulsion system.

Since the gas vaporized onboard FSRU 100 is produced from LNG, the gas discharged from FSRU 100 is high quality since carbon dioxide, hydrogen sulfide, water, mercury and other impurities must be removed prior to liquefaction, and no impurities are added to the gas during pressurization and vaporization procedures. Further, natural gas discharged from FSRU 100 may be high pressure, such as at least $41\times10^5$ Pa (40 barg) and may be pressurized at a pressure of up to 101×105 Pa (100 barg) in some embodiments, or up to $401\times10^5$ Pa (400 barg) in certain embodiments. In some embodiments, the pressure of injected natural gas for gas lift should be at least greater than the pressure of produced fluid flowing through production tubing 145 of oil well 150.

Pumps onboard FSRU 100 may provide pressurization to LNG and/or natural gas onboard FSRU 100 in order to produce high pressure natural gas for gas lift injection without the need for compression. FIGS. 2A-2D illustrate LNG pressurization systems of illustrative embodiments. LNG cargo 200 may be stored at or slightly above atmospheric pressure onboard FSRU 100 in LNG cargo tank 125. FSRU 100 may be loaded with LNG cargo 200 from a location liquefying and exporting natural gas, and FSRU 100 may transport LNG cargo 200 across the ocean prior to FSRU 100 docking at buoy 105. Alternatively, FSRU 100 may remain moored at buoy 105 or platform 155 and be replenished with LNG cargo 200 using ship-to-ship transfer of LNG cargo 200 from an LNGC. Tanks 125 and piping onboard FSRU 100 storing or transmitting LNG cargo 200 and/or high pressure LNG 260 may be cryogenic, for example stainless steel type 316 or another similar material. Flanges and valves may further direct fluid flow onboard FSRU 100, and a control panel may allow an operator and/or computer to open and close the vales as desired. Feed pump 205 may impart enough pressure to remove LNG cargo 200 from cargo tank 125, for example 2.5-3 barg. Feed pump 205 may for example be a centrifugal pump or another similar type of fluid-moving pump. One or more cargo tanks 125 may include feed pump 205. Where a particular cargo tank 125 does not include a feed pump 205, LNG cargo 200 may be transferred between cargo tanks 125 to remove LNG cargo 200 from each cargo tank 125 as needed to supply natural gas as more specifically described herein.

Figure 2A:
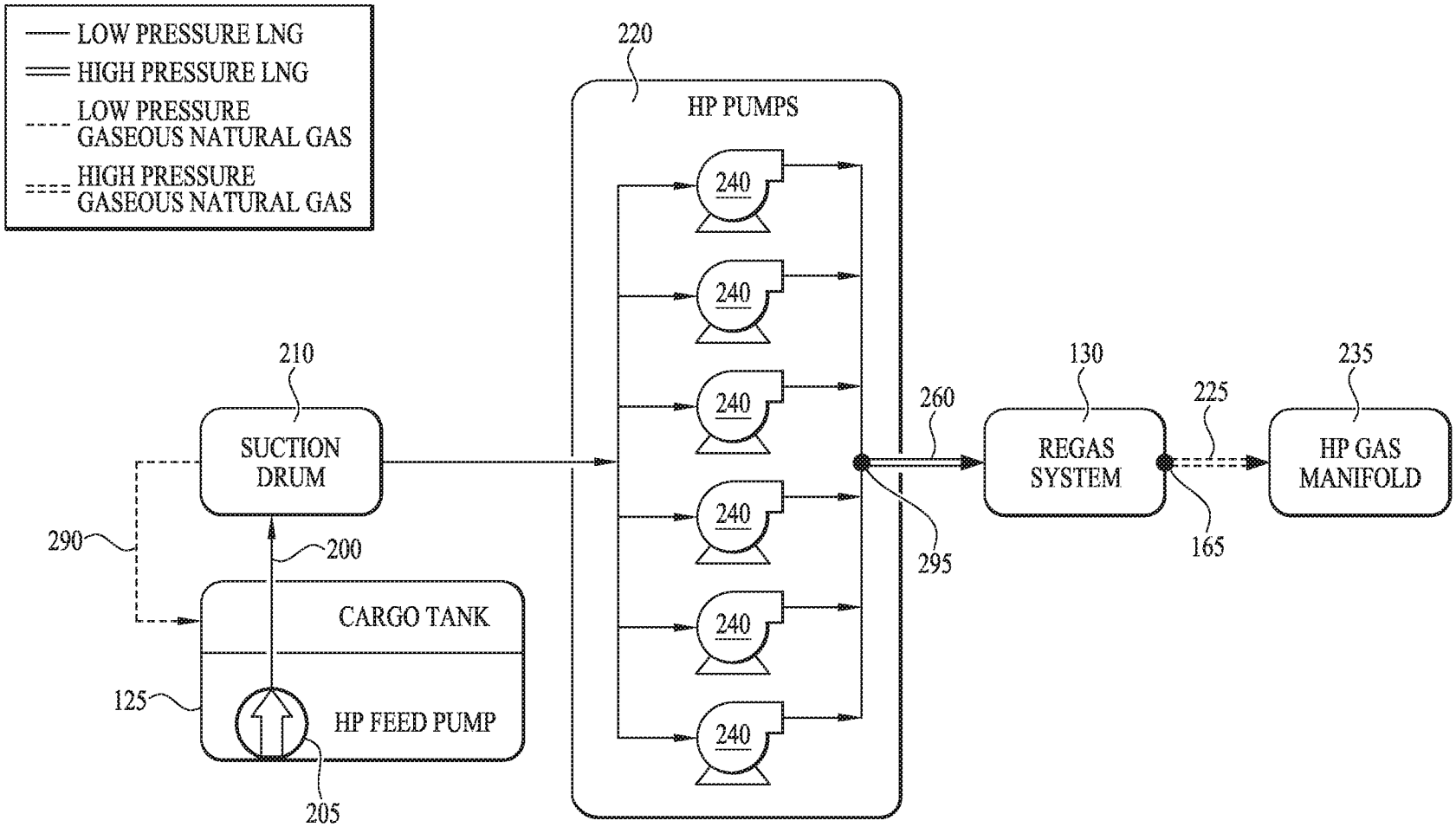
FIGS. 2A-2D are a schematic diagrams of shipboard LNG pressurization and vaporization systems of illustrative embodiments.
Figure 2B:
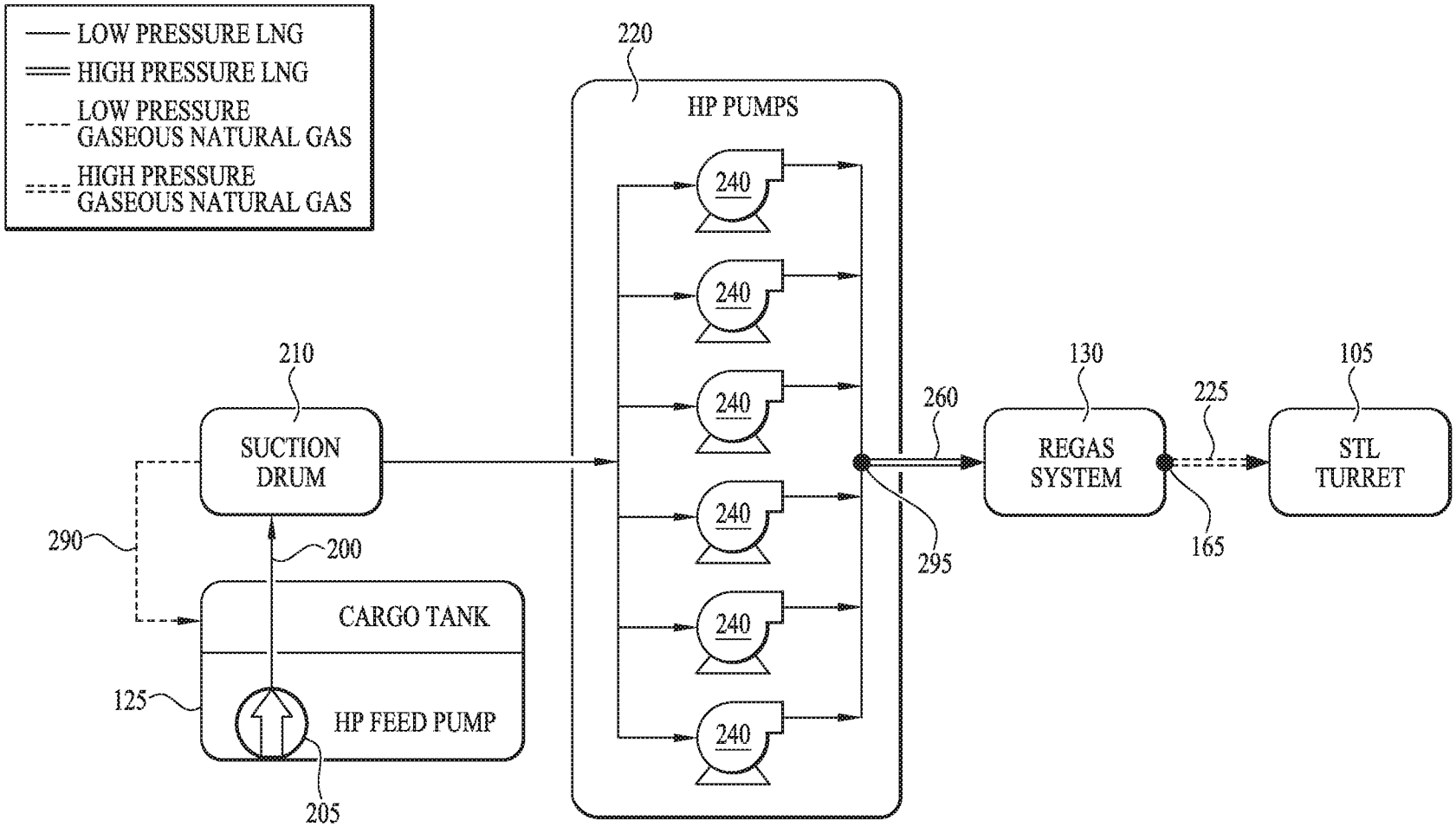
Figure 2C:
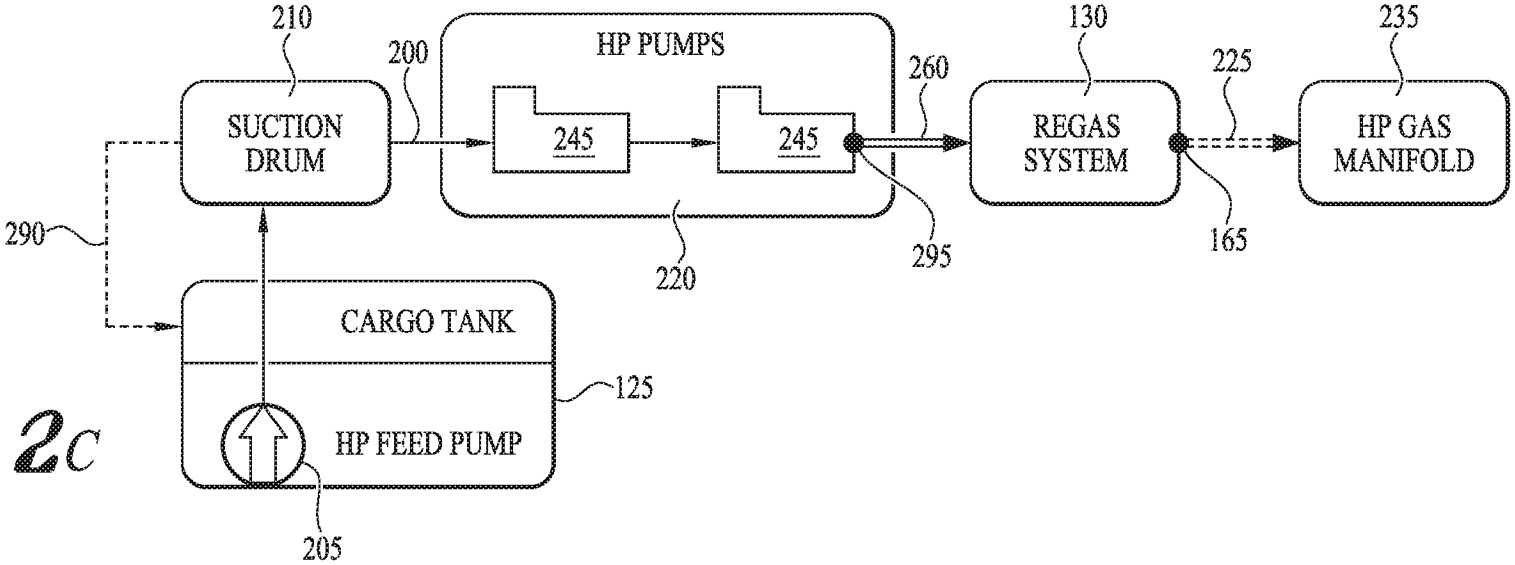
Figure 2D:
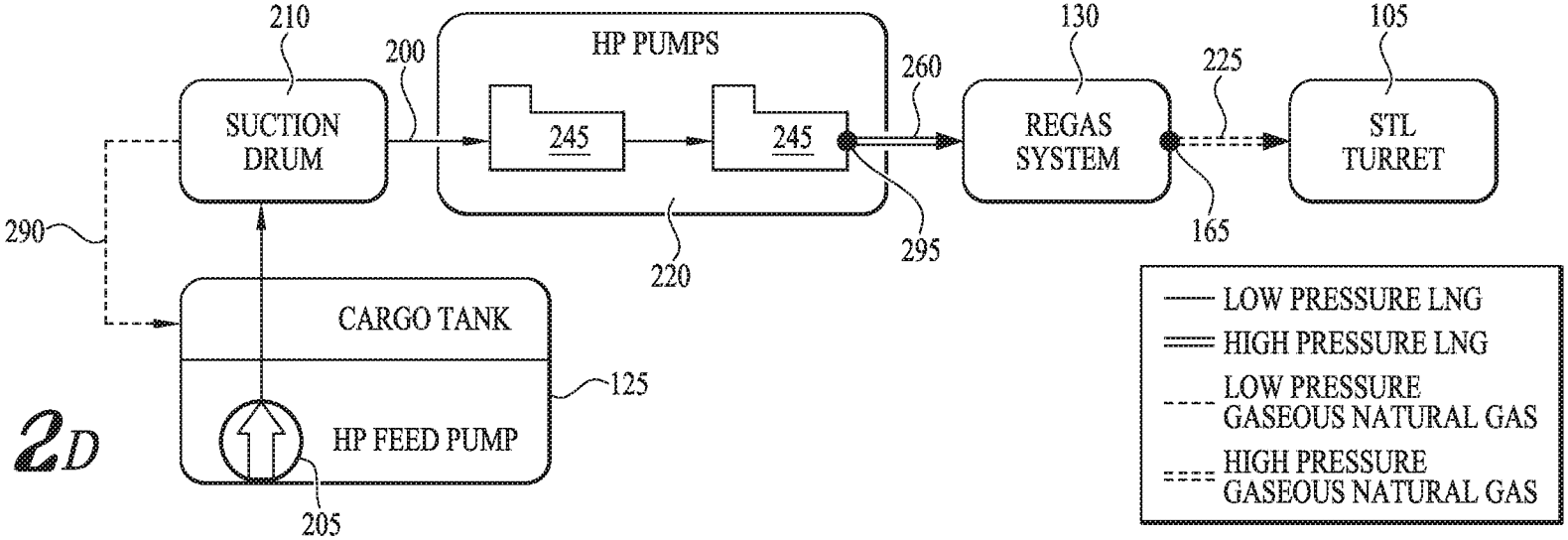
Figure 2E:
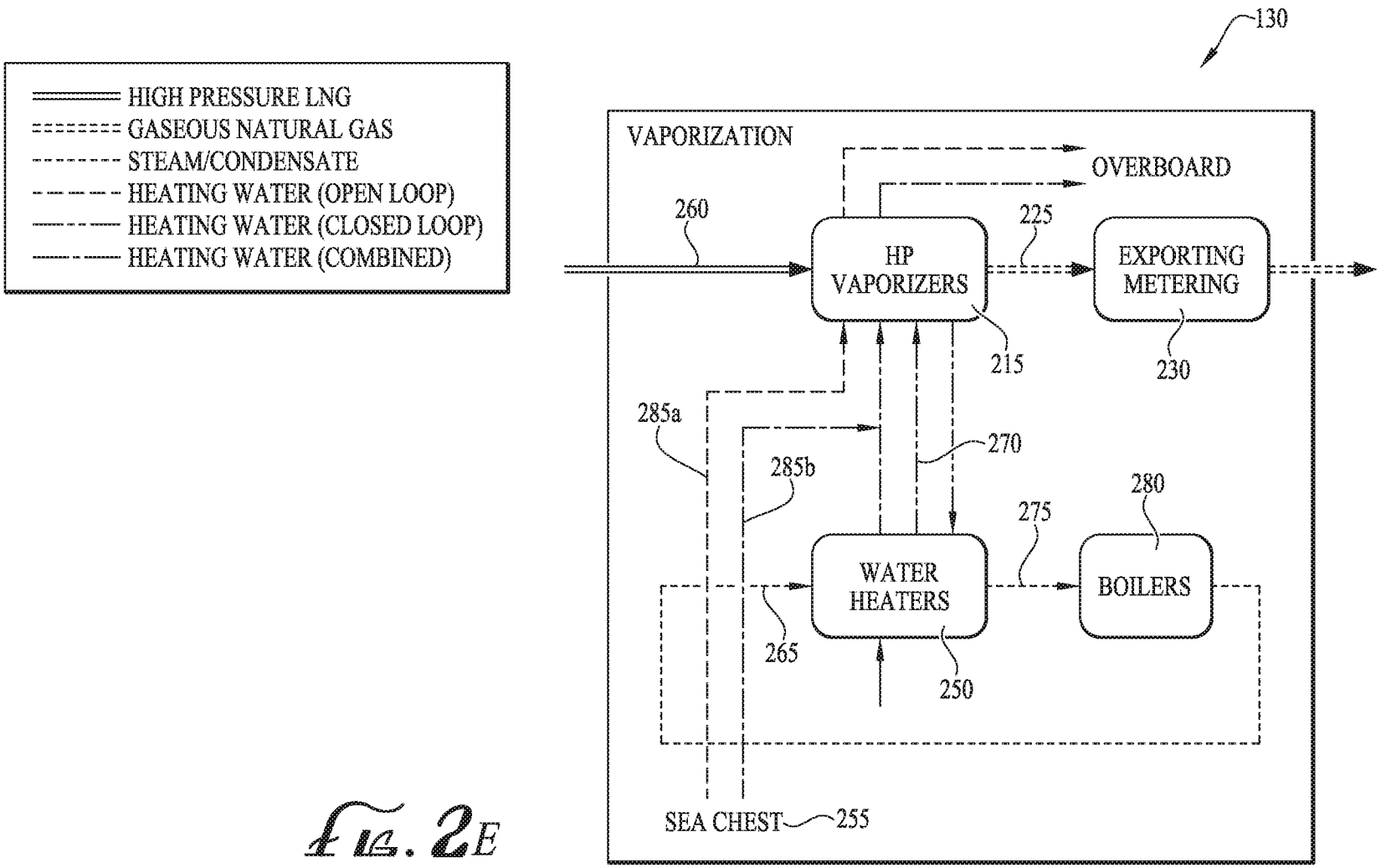
FIG. 2E is a schematic diagram of a regasification system of an illustrative embodiment of the shipboard LNG pressurization and vaporization system of FIGS. 2A-2D.

LNG cargo 200 may pass from cargo tank 125 into suction drum 210 prior to entering high pressure pump system 220 and vaporizers 215 (shown in FIG. 2E). Suction drum 210 may ensure that only liquid passes to vaporizers 215 by separating any vapor 290 that may be mixed with LNG cargo 200. Vapor 290 separated from LNG cargo 200 by suction drum 210 may be returned to cargo tank 125 whilst LNG cargo 200 at low pressure continues to the suction side of high pressure pump system 220. In some embodiments, low pressure LNG 200 may pass directly to the suction side of high pressure pump system 220 without the need for suction drum 210. The suction of high pressure pump system 220 may be about 2.5-3 barg and/or the pressure imparted to LNG 200 from feed pump 205 sufficient to move low pressure LNG 200 from cargo tanks 125 and into suction drum 210 and/or high pressure pump system 220.

Figure 5A:
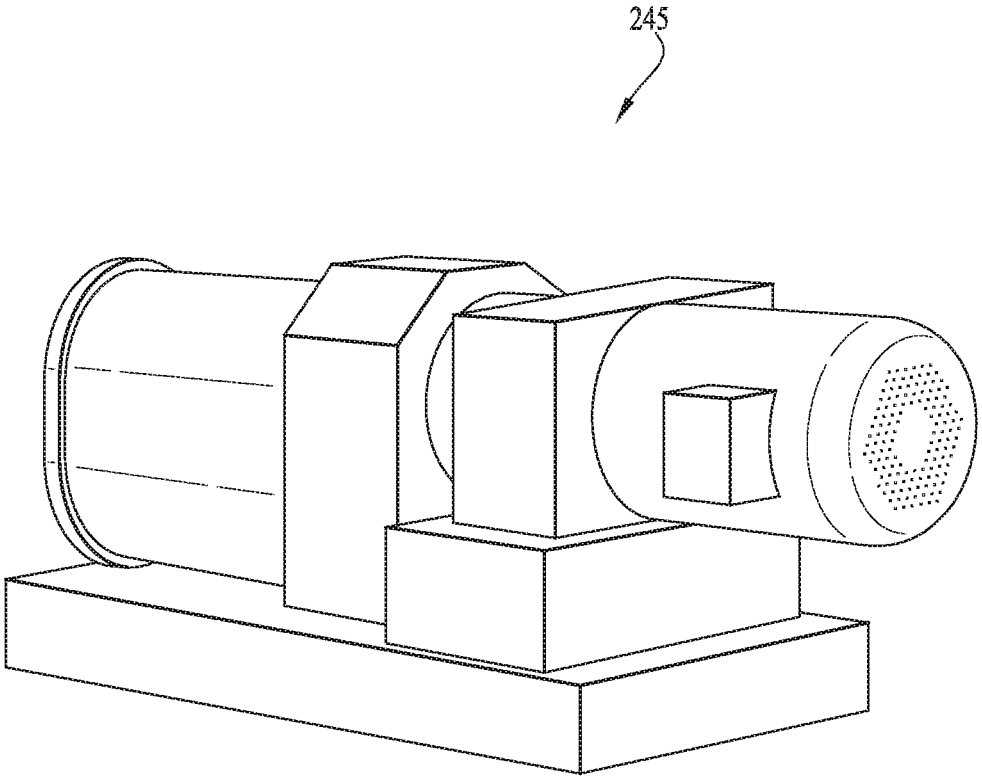
FIG. 5A is a perspective view of a LNG pressurization pump of an illustrative embodiment.
Figure 5B:
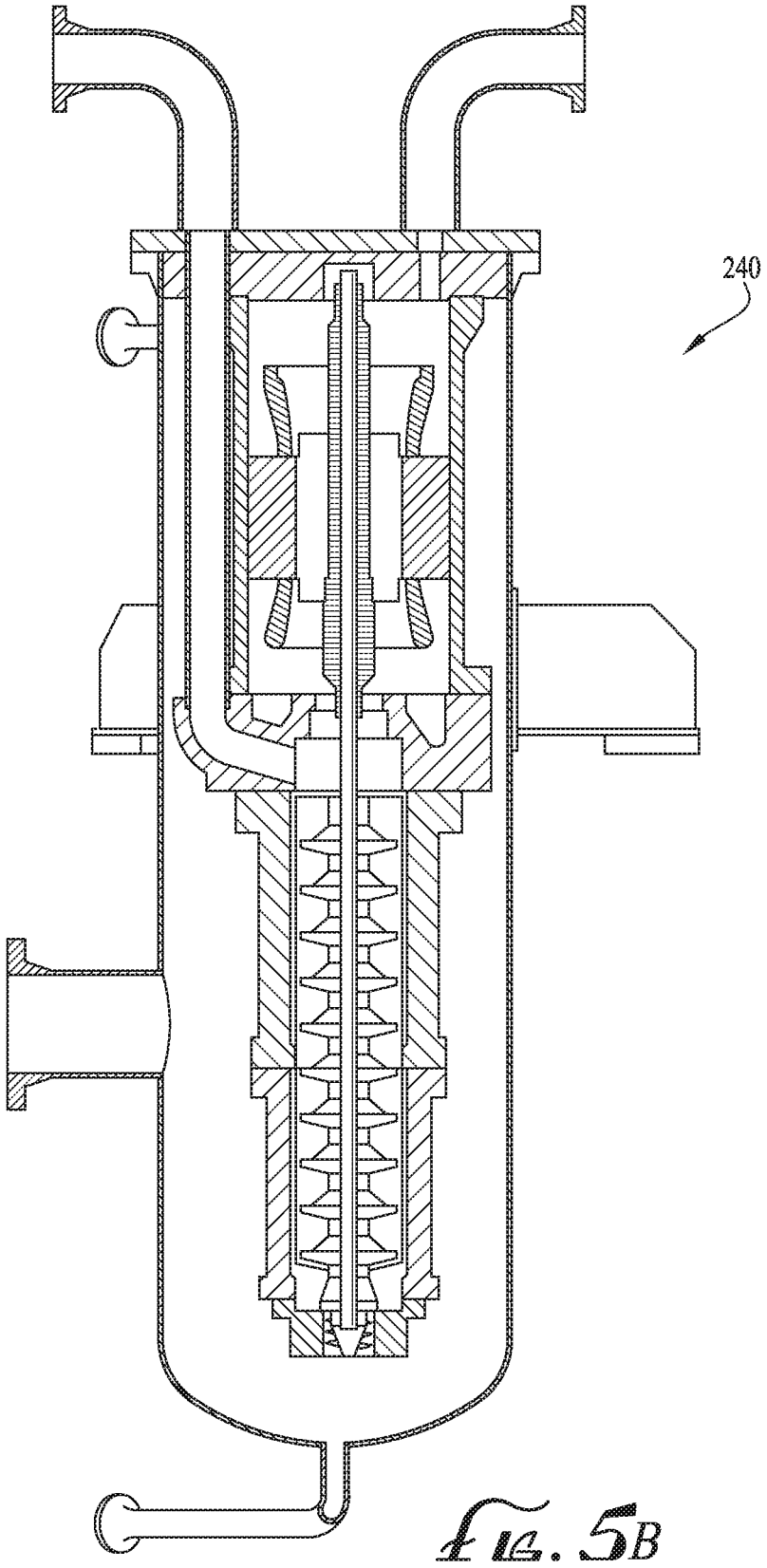
FIG. 5B is a cross-sectional view of an LNG pressurization pump of an illustrative embodiment.
Figure 9:
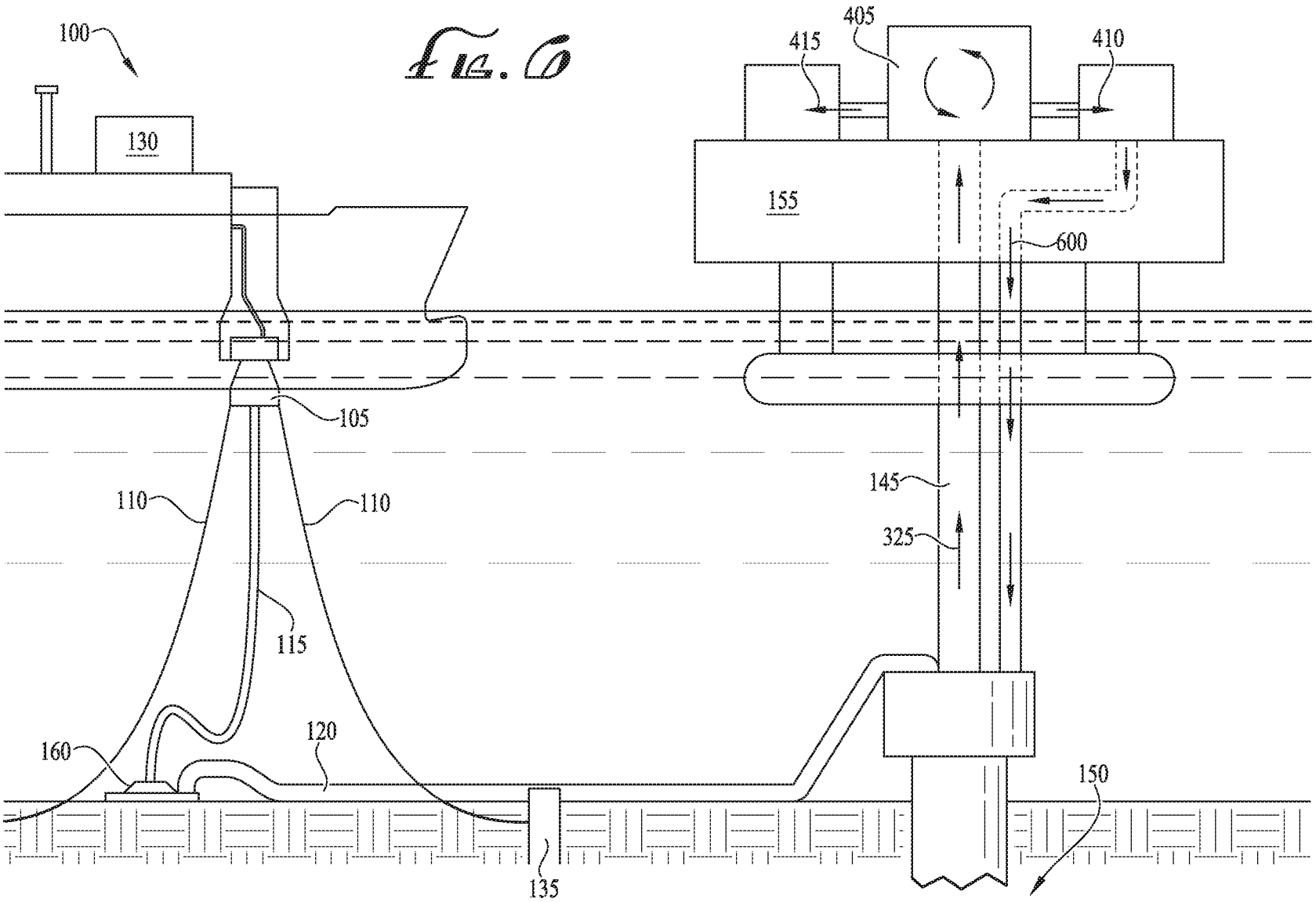

One or more pumps may be included in high pressure pump system 220 onboard FSRU 100. High pressure pump system 220 may receive low pressure LNG cargo 200 from cargo tank 125 and/or suction drum 210 and discharge high pressure LNG 260 to regasification system 130 and/or vaporizers 215 through high pressure LNG discharge 295. High pressure pump system 220 may include six multi-stage centrifugal pumps 240 connected in parallel, as shown in FIGS. 2A-2B. In the embodiment of FIGS. 2A-2B, high pressure pump system 220 and a plurality of vaporizers 215 in parallel trains may be capable of a regasification rate of 100 to 160 MMScfd at up to $101\times10^5$ Pa (100 barg). In another example, four multistage centrifugal pumps 240 may be connected in series. An exemplary multistage centrifugal pump 240 is illustrated in FIG. 5B. In yet another example, high pressure pump system 220 may be one or more positive displacement pumps 245 such as a rotary lobe pump or reciprocating pump. Multiple positive displacement pumps 245 connected in series, such as between two and eight positive displacement pumps 245, may impart increased pressure to low pressure LNG cargo 200, as shown in FIGS. 2C-2D. In one example, six multi-stage centrifugal pumps 240 connected in parallel may provide between $41\times10^5$ Pa (40 barg) and $101\times10^5$ Pa (100 barg), and two positive displacement pumps 245 in series may provide between $101\times10^5$ Pa (100 barg) and $401\times10^5$ Pa (400 barg) pressure. Pump type and arrangement may depend on the conditions and/or production pressure of oil well 150. FIG. 5A further illustrates a positive displacement pump 245 onboard FSRU 100 of an illustrative embodiment. For gas lift, it is currently preferred that the pressure of high pressure LNG 260 exiting high pressure pump system 220 and/or high pressure natural gas exiting regasification system 130 is at least higher than production tubing 145 pressure. Thickness and/or strength of piping carrying high pressure LNG 260 onboard FSRU 100 may be commensurate with fluid pressures of up to $101\times10^5$ Pa (100 barg) or up to $401\times10^5$ Pa (400 barg).

Conventionally, compressors and not pumps are used to pressurize gas for gas lift. For offshore oil wells, the compressors are placed atop offshore platforms, consuming large amounts of power and space, where both are at a premium. However, the inventors have observed that the specialized high pressure pump system 220 of illustrative embodiments onboard FSRU 100 is significantly more efficient and economical than conventional compressors used to pressurize injection gas, and this high pressure pump system 220 may be used to obviate the need for compressors for pressurization of injection gas for gas lift, and further improve gas lift systems.

Table 1 sets forth a non-limiting and exemplary illustration of the improvement high pressure pump system 220 provides as compared to conventional compressors for pressurization of gas lift injection gas.

TABLE 1

| Parameter | Exemplary high pressure pump system 220 | Conventional compressor |
|---|---|---|
| Suction Pressure (Pa) | $5\times10^5$ | $66\times10^5$ |
| Discharge Pressure (Pa) | $101\times10^5$ | $101\times10^5$ |
| Flowrate (MMScfd) | 100.0 | 100.0 |
| Shaft power (kW) | 690.0 | 1,590.0 |

With respect to Table 1, note that the suction pressure of $66\times10^5$ for compressors has been arbitrarily selected as production separator pressure. Similar power consumption to high pressure pumps 220 provides an additional 10-15$\times10^5$ Pa (10-15 barg), depending on suction pressure. As is apparent from Table 1, high pressure pumps 220 are significantly more efficient, consuming significantly less kilowatts of power and able to accept much lower suction pressure in order to provide the same or better discharge pressure as compared to compressors. High pressure pumps 220 and/or regasification system 130 may have a high turndown capability as compared to compressors if excess gas cannot be exported. For example, in an embodiment where there are six centrifugal pumps 240 with a peak flowrate of 115 MMScfd, the turndown capability may be 50 to 690 MMScfd. In another example, an individual centrifugal pump 240 may turn down from 100 to 50 MMScfd or 140 to 70 MMScfd and a plurality of centrifugal pumps 240 may be employed to improve turndown. Pumps may allow more turndown more economically than compressors due to the high capital cost of compressors.

Regasification system 130 and/or vaporizers 215 onboard FSRU 100 may receive high pressure LNG 260 from high pressure pumps 220 and convert high pressure LNG 260 to high pressure gaseous natural gas 225 by adding heat to high pressure LNG 260 while maintaining high pressure during the phase transition. FIG. 2E illustrates a regasification system 130 of illustrative embodiments. Vaporizer 215 of regasification system 130 may for example be shell and tube vaporizers that may transfer heat directly or indirectly to high pressure LNG 260, or employ a combination of direct or indirect heat. One or more heat sources may be employed to regasify high pressure LNG 260. One heat source may be steam 265 from main and/or auxiliary boilers 280 onboard FSRU 100, which steam 265 may provide heat to an intermediate fluid 270 (such as glycol, sea water, fresh water or a glycol and fresh water mixture) through water heater 250. The intermediate fluid 270 may be circulated in a closed loop through vaporizers 215 and then returning to water heaters 250. After steam 265 passes through water heater 250, steam condensate 275 may be returned to boilers 280 (main or auxiliary) to increase the thermal efficiency of regasification system 130. Alternatively or additionally, seawater 285*a*, 285*b* surrounding FSRU 100 may be used as a heat source to vaporize high pressure LNG 260. Seawater 285*a* may flow through sea chest 255 of FSRU 100 to provide direct heat to vaporizers 215 and then discharge overboard at a lower temperature in an open loop. Alternatively, seawater 285*b* may provide heat to intermediate fluid 270, which intermediate fluid 270 may in turn flow through vaporizer 215. In some embodiments, high pressure pump system 220 may be integral to and/or integrated into regasification system 130. In certain embodiments, high pressure pump system 220 may be district from regasification system 130.

A combination of heat provided by closed-loop steam 265 and open-loop sea water 285*a* may also be employed and/or one or more of any of the heat sources described herein may be employed for vaporization of high pressure LNG 260 in various combinations. Other heat sources are also contemplated, such as ambient air through the use of air heat exchangers. In closed loop or combined regasification modes, the cold of high pressure LNG 260 may be used to indirectly cool other equipment onboard the FSRU and/or recondense or manage boil-off gas from LNG cargo tanks 125. At peak sendout rates, conventional vaporizers are limited to sendout at temperatures of around seawater inlet temperature minus circa 10° C. In some embodiments, multiple parallel vaporizers 215 of illustrative embodiments and/or improved heat generation of regasification system 130 onboard FSRU 100 may raise the temperature of high pressure natural gas 225 above 5° C., such as for example to a temperature of 35° C. by employing additional or alternative heat sources to seawater 285*a*, 285*b* as described herein.

With reference to FIGS. 2A-2E, natural gas 225 exiting high pressure discharge 165 of vaporizer 215 may be high pressure gaseous natural gas, which may be sent to metering equipment 230 and then either to high pressure gas manifold 235 and high pressure arm 800, or to buoy 105, such a submerged turret loading buoy. High pressure natural gas 225 output from FSRU 100 may be at or about high pressure pump 220 discharge pressure. Since high pressure natural gas 225 has previously been pretreated before liquefaction, no sweetening or dehydration is required on offshore platform 155 prior to injection of high pressure natural gas 225 into oil well 150. Further, direct injection of high pressure natural gas 225 from FSRU 100 eliminates conventional problems associated with contaminants such as water, $CO_2$ and $H_2S$.

Figure 3:
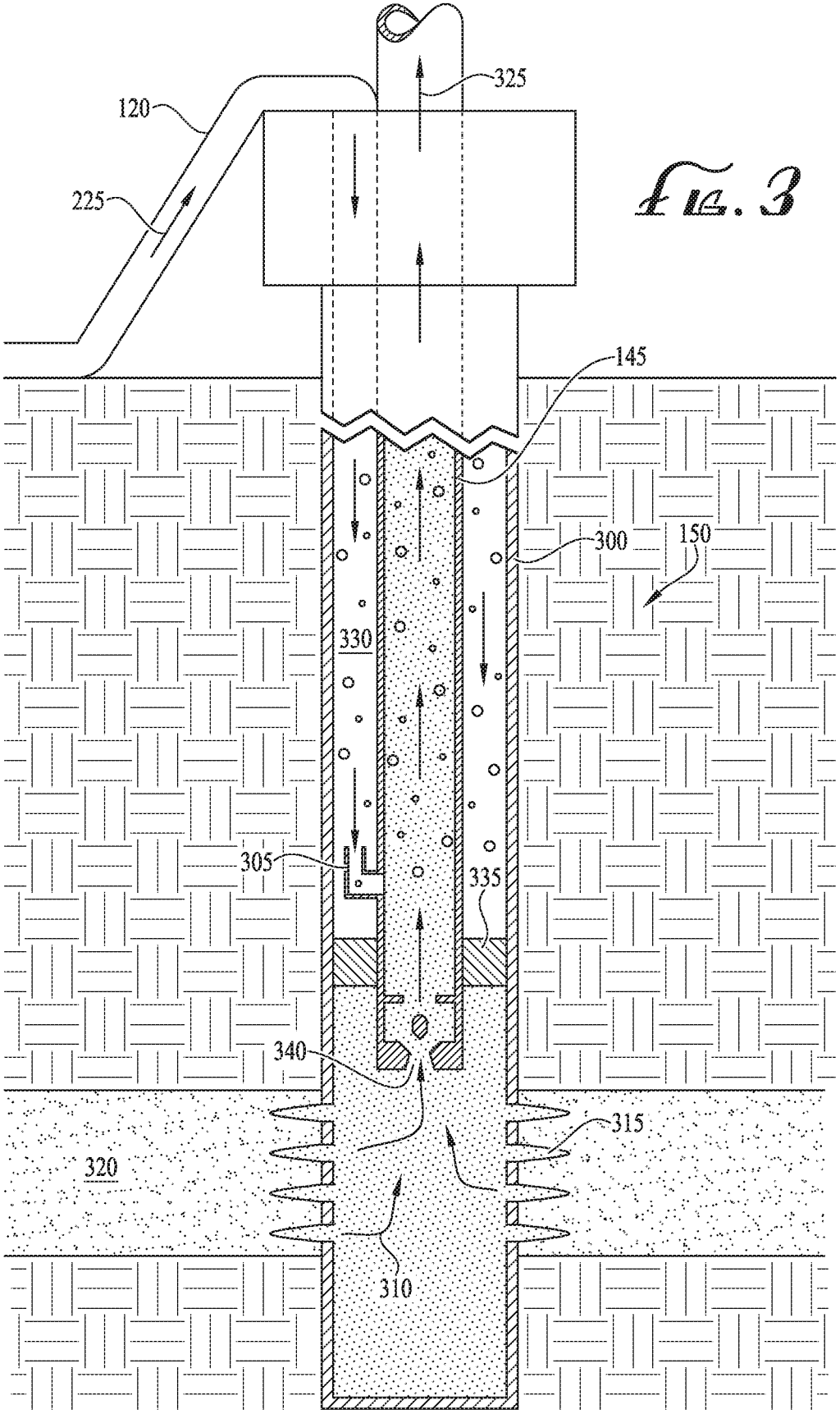
FIG. 3 is a cross sectional view of an exemplary gas lift system of an illustrative embodiment.

Turning to FIG. 3, high pressure natural gas 225 carried by natural gas pipeline 120 may be employed for gas lift. In gas lift embodiments, high pressure natural gas 225 discharged from FSRU 100 may be injected into oil well 150 through gas pipeline 120, and into annulus 330 between well casing 300 and production tubing 145. Production tubing valve 305 may control flow of high pressure natural gas 225 into production tubing 145 and/or allow high pressure natural gas 225 to enter production tubing 145. Annulus 330 below valve 305 may be sealed, for example by plate 335 and/or another type of barrier and/or o-rings, such that injected high pressure natural gas 225 cannot substantially bypass valve 305 and downhole fluid 310 cannot substantially bypass production tubing 145. Downhole fluid 310 from formation 320, such as crude oil, indigenous natural gas, other downhole gas such as nitrogen, carbon dioxide and/or water, may enter casing 300 through casing perforations 315 and continue inside production tubing 145 through inlet 340. Inside production tubing 145, high pressure natural gas 225 from FSRU 100 may mix with downhole fluid 310 travelling towards the surface of oil well 150, which mixing may decrease the density of downhole fluid 310 and improve pressure lift from oil well 150. Combined stream of production fluid 325, which may consist of downhole fluid 310 mixed with natural gas 225 from FSRU 100, may be produced to offshore platform 155 through production tubing 145, which production tubing 145 may extend from downhole within oil well 150 to platform 155. In certain gas lift systems, such as the exemplary gas lift system of FIG. 3, the pressure of high pressure natural gas 225 injected into annulus 330 is currently preferred to be greater than the pressure of the stream of production fluid 325 being lifted from oil well 150. The pressure of high pressure natural gas 225 may be minimally or slightly higher than the pressure of production fluid 325 such as $1\times10^5$ Pa, $2\times10^5$ Pa or a few $10^5$ Pa higher, or may be $10\times10^5$ Pa, $20\times10^5$ Pa, $30\times10^5$ Pa or more, higher than the pressure of production fluid 325.

Figure 4:
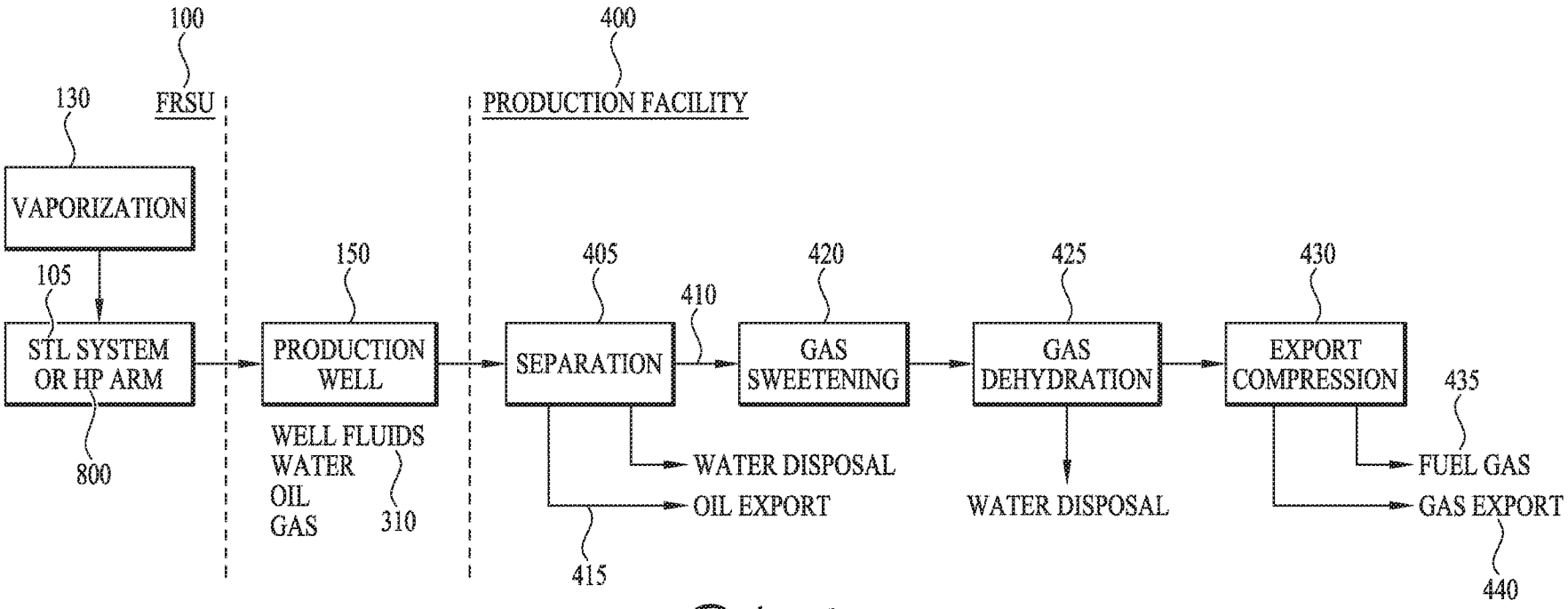
FIG. 4 is a schematic diagram of a floating gas lift system of an illustrative embodiment.

Combined stream of production fluid 325 carried by production tubing 145 may be lifted to offshore platform 155. Turning to FIG. 4, offshore platform 155 may include production facility 400. Production facility 400 may include separation equipment 405, which may separate produced gas 410 from produced liquid 415 contained in combined stream of production fluid 325, for example by using gravity to induce separation by density. Water and oil from produced liquid 415 may also be separated onboard offshore platform 155 and/or produced liquid 415 may be transported by pipeline to another location for further treatment and/or distribution. Produced gas 410 separated from combined stream of production fluid 325 may include high quality natural gas 225 from FSRU 100 as well as other gas originating from oil well 150 and/or formation 320 such as indigenous natural gas, nitrogen or carbon dioxide. Produced gas 410 from combined stream of production fluid 325 may be better quality than indigenous downhole gas alone, since produced gas 410 may have lower concentrations of $N_2$, $CO_2$ and $H_2S$, which may minimize safety risk and increase the reliability of fired equipment. In some embodiments, produced gas 410 may be recirculated as injection gas back into oil well 150, may be exported for distribution, burning or other use, and/or may be used as fuel gas for equipment onboard offshore platform 155. In some embodiments, produced gas 410 may be treated with gas sweetening equipment 420, gas dehydration equipment 425 and export compression 430, prior to use as fuel gas 435 or exported gas 440. If employed as fuel gas 435, produced gas 410 may be used to provide power for treatment equipment, generators or other facilities onboard offshore platform 155, for example by fueling a natural gas generator. Although separated gas 410 may be contaminated by well fluids 310, the purity of high pressure natural gas 225 from FSRU 100 may allow further use of produced gas 410 with only minimal to no additional treatment. If produced gas 410 is used for fuel gas 435 or is exported to shore 710 (shown in FIG. 7), natural gas 225 from FSRU 100 may replenish high pressure natural gas 225 for injection, fuel gas 435 and/or export gas 440 as needed.

FIG. 6 illustrates a gas lift system of an illustrative embodiment. As shown in FIG. 6, combined stream of production fluid 325 lifted through production tubing 145 is transported to separation system 405 onboard offshore platform 155. Produced liquid 415 separated from combined stream of production fluid 325 may be collected for further treatment and/or may be further transmitted by liquid pipeline or off-taken by tanker vessel. Produced gas 410 may be recirculated downhole for injection into annulus 330 as illustrated by recirculation flow 600. Due to the purity of high pressure natural gas 225 from FSRU 100, separated produced gas 410 may be recirculated several times and/or a plurality of times without the need for prior treatment or purification such as without the need for gas sweetening or dehydration, depending on the content of downhole fluid 310.

Figure 7:
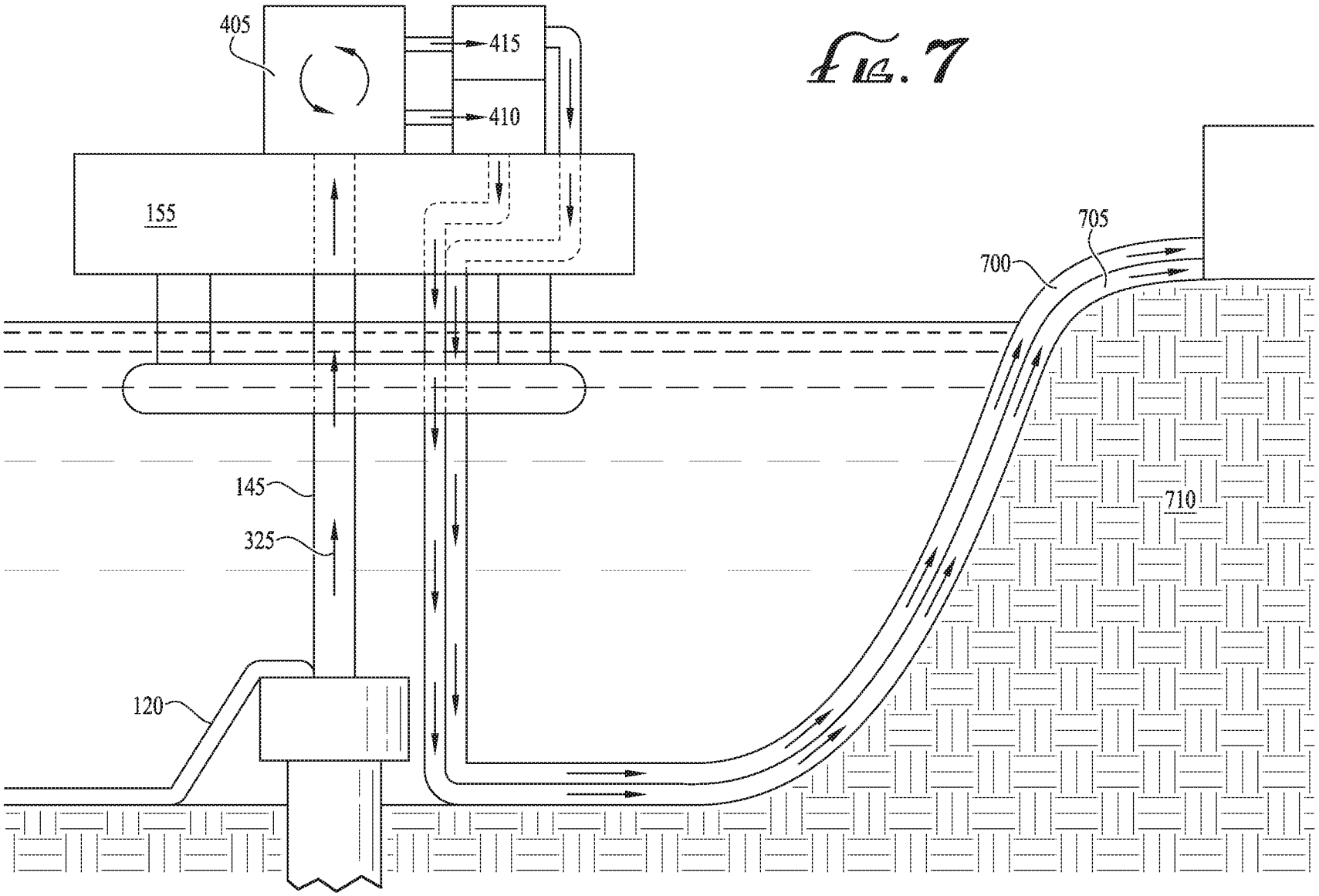
FIG. 7 is a side elevation view of an offshore gas lift method with natural gas supply distribution.

FIG. 7 illustrates a gas lift system of an illustrative embodiment whereby produced gas 410 and produced liquid 415 separated from combined stream of production fluid 325 are sent by subsea liquid pipeline 700 and subsea gas pipeline 705 to shore 710 for further treatment and/or distribution. Produced gas 410 may be supplied to downstream power users, utilities and/or sent for further distribution. Produced liquid 415 may be sent for further separation (e.g., oil, natural gas liquids and water separation)

and/or processing, treatment or further distribution. In some embodiments, offshore platform 155 may be a dock, and subsea gas pipeline 705 and subsea liquid pipeline 700 may extend along the dock to shore 710, rather than travelling along the ocean floor.

Figure 8:
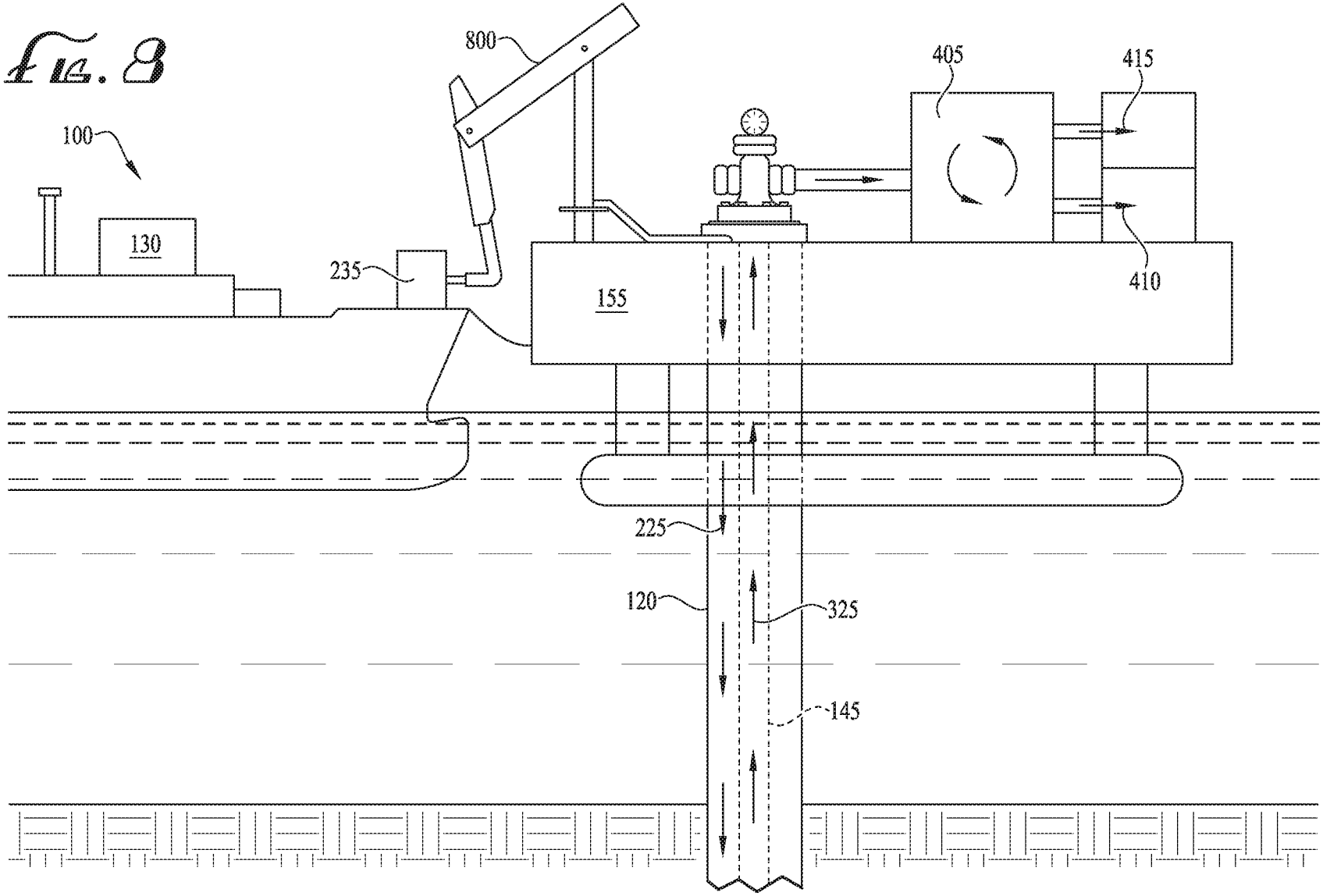
FIG. 8 is a side elevation view of a gas lift system of an illustrative embodiment including an exemplary high pressure arm.

FIG. 8 illustrates an illustrative high pressure arm embodiment. In FIG. 8, high pressure natural gas 225 is discharged from regasification system 130 through high pressure gas manifold 235 using a high pressure gas arm 800. In embodiments employing gas arm 800, no buoy 105 is needed. Gas arm 800 may receive high pressure natural gas 225 and fluidly connect to gas pipeline 120 for injection of high pressure natural gas 225 into oil well 150. High pressure gas arm 800 may sit on offshore platform 155 and/or FSRU 100 and may accommodate movement of FSRU 100 with respect to offshore platform 155 due to swell, current, waves and weather.

Although the systems and methods described herein are primarily in terms of offshore oil wells and/or hydrocarbon wells, FSRU 100 may be employed for gas lift systems onshore, where high pressure natural gas 225 from FSRU 100 may be transported by gas pipeline 120 onshore for injection into an onshore oil well 150 for gas lift. In such instances, FSRU 100 may be moored at a dock, and may transport high pressure natural gas 225 through high pressure gas manifold 235 and/or high pressure arm 800. In addition, high pressure natural gas 225 may be supplied to multiple oil wells 150 via subsea manifold 160 where natural gas pipeline 120 may branch or multiple natural gas pipelines 120 are employed.

Illustrative embodiments may provide stable export compression suction conditions providing more reliable operation, particularly if the injection gas 225 to produced gas 410 ratio is high. Illustrative embodiments may provide a constant supply of high pressure natural gas 225 as injection gas, which may reduce the potential for production outages. Illustrative embodiments may eliminate the requirement of supplying significant quantities of nitrogen or carbon dioxide to remote locations. In embodiments where LNG is imported, high pressure natural gas 225 from FSRU 100 may be productively used prior to sale (subject to export conditions).

A floating gas lift system, apparatus and method has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A floating gas lift method comprising:

pumping liquefied natural gas (LNG) onboard a floating storage regasification unit (FSRU) through a high-pressure pump system without a compressor from at least one LNG cargo tank to a regasification system onboard the FSRU to pressurize the LNG and form high-pressure LNG, wherein the FSRU comprises a ship-to-ship transfer manifold configured to transfer LNG cargo from a marine LNG carrier to the at least one LNG cargo tank onboard the FSRU;

vaporizing the high-pressure LNG onboard the FSRU to produce high-pressure regasified natural gas;

injecting the high-pressure regasified natural gas from the FSRU into an annulus of a subsea hydrocarbon well, the annulus between a well casing and a production tubing of the subsea hydrocarbon well;

controlling a flow of the high-pressure regasified natural gas from the annulus into the production tubing using a production tubing intake valve and a barrier below the intake valve;

lifting a combined fluid through the production tubing, the combined fluid comprising:

regasified natural gas from the FSRU entering the production tubing through the production tubing intake valve; and a downhole hydrocarbon fluid entering the production tubing through a production tubing inlet below the barrier;

receiving the combined fluid on an offshore platform;

separating the combined fluid into produced liquid and produced gas on the offshore platform;

recirculating at least a portion of the produced gas from the offshore platform into the annulus;

using at least a second portion of the produced gas as fuel for equipment onboard the offshore platform;

treating the second portion of the produced gas prior to use as fuel; and replenishing the at least one LNG cargo tank onboard the FSRU with the LNG cargo for injection into the annulus of the subsea hydrocarbon well using the ship-to-ship transfer manifold.

2. The floating gas lift method of claim 1, further comprising mooring the FSRU at a submerged buoy prior to injecting the high-pressure regasified natural gas into the annulus of the subsea hydrocarbon well.

3. The floating gas lift method of claim 2, wherein injecting the high-pressure regasified natural gas from the FSRU into the annulus of the subsea hydrocarbon well further comprises flowing the high-pressure regasified natural gas from the FSRU through the submerged buoy, through a flexible riser, into a subsea manifold, and into the annulus.

4. The floating gas lift method of claim 1, wherein injecting the high-pressure regasified natural gas from the FSRU into the annulus of the subsea hydrocarbon well further comprises transferring the high-pressure regasified natural gas from the FSRU to a high-pressure gas manifold, and flowing the high-pressure regasified natural gas from the high-pressure gas manifold into the annulus.

5. The floating gas lift method of claim 1, further comprising mooring the FSRU at the offshore platform for injection of the high-pressure regasified natural gas from the FSRU in the annulus.

6. The floating gas lift method of claim 1, wherein treating the second portion of the produced gas further comprises:

sweetening, dehydration, export compression or a combination thereof.

7. The floating gas lift method of claim 1, further comprising transmitting the at least a third portion of produced gas from the offshore platform to onshore for distribution.

* * * * *